US009790047B2

(12) United States Patent
Snir

(10) Patent No.: US 9,790,047 B2
(45) Date of Patent: Oct. 17, 2017

(54) TENSIONING MECHANISM FOR A TEXTILE FEED TO A STEPPED OPERATION DIGITAL TEXTILE PRINTER

(71) Applicant: Kornit Digital Technologies Ltd., Rosh HaAyin (IL)

(72) Inventor: Ohad Snir, Kiryat-Ono (IL)

(73) Assignee: Kornit Digital Technologies Ltd., Rosh HaAyin (IL)

( * ) Notice: Subject to any disclaimer, the term of this patent is extended or adjusted under 35 U.S.C. 154(b) by 415 days.

(21) Appl. No.: 14/455,912

(22) Filed: Aug. 10, 2014

(65) Prior Publication Data

US 2016/0039626 A1 Feb. 11, 2016

(51) Int. Cl.

| | |
|---|---|
| ***B65H 23/04*** | (2006.01) |
| ***B41J 15/02*** | (2006.01) |
| ***B65H 20/02*** | (2006.01) |
| ***B65H 20/24*** | (2006.01) |
| ***B65H 23/188*** | (2006.01) |

(Continued)

(52) U.S. Cl.

CPC ..... *B65H 23/048* (2013.01); *B41J 3/4078* (2013.01); *B41J 15/02* (2013.01); *B41J 15/16* (2013.01); *B65H 20/02* (2013.01); *B65H 20/24* (2013.01); *B65H 23/04* (2013.01); *B65H 23/1888* (2013.01); *B65H 2403/41* (2013.01); *B65H 2403/942* (2013.01); *B65H 2404/261* (2013.01); *B65H 2701/174* (2013.01); *B65H 2801/15* (2013.01); *D06P 5/30* (2013.01)

(58) Field of Classification Search

CPC .. B65H 23/048; B65H 20/24; B65H 23/1888; B65H 20/02; B65H 23/04; B65H 2403/942; B65H 2404/261; B65H 2403/41; B65H 2801/15; B65H 2701/174; B41J 3/4078; B41J 15/16; B41J 15/02; D06P 5/30

See application file for complete search history.

(56) References Cited

U.S. PATENT DOCUMENTS 3,283,982 A * 11/1966 Haskin, Jr. ..... B65H 23/048 226/195
4,070,951 A * 1/1978 Bala ..... B65H 20/24 226/113

(Continued)

FOREIGN PATENT DOCUMENTS

| | | | |
|---|---|---|---|
| EP | 1780029 | | 5/2007 |
| GB | 770699 | * | 3/1957 |

OTHER PUBLICATIONS

European Search Report and the European Search Opinion dated Jan. 12, 2016 From the European Patent Office Re. Application No. 15179555.6.

*Primary Examiner* — William A Rivera

(57) ABSTRACT

A textile feed for a stepped operation digital textile printer, comprises a textile feeding mechanism, and a tension storage mechanism. The textile feeding mechanism feeds the textile in a forward direction onto the printer, but is at the same time mechanically connected to a tension storage mechanism which is tensioned by the forward feeding. At the end of the feed step, the tension storage mechanism releases respectively stored tension to cause the feed mechanism to briefly reverse feed, thereby to pull the textile taut and take up any slack caused by the feeding step. The textile is thus kept taut, to allow effective digital printing by the printer.

14 Claims, 19 Drawing Sheets

(51) Int. Cl.

| | |
|---|---|
| ***B41J 3/407*** | (2006.01) |
| ***B41J 15/16*** | (2006.01) |
| *D06P 5/30* | (2006.01) |

(56) References Cited

U.S. PATENT DOCUMENTS

| | | | | | |
|---|---|---|---|---|---|
| 4,417,516 | A * | 11/1983 | Fischer | B65H 23/1888 | 101/181 |
| 4,848,630 | A * | 7/1989 | Niestrath | B41F 13/025 | 101/248 |
| 5,825,374 | A * | 10/1998 | Albertalli | B41J 11/0085 | 226/156 |
| 6,295,925 | B1 * | 10/2001 | Sarni | B65H 20/02 | 101/228 |
| 6,471,152 | B1 * | 10/2002 | Suzuki | B65H 23/048 | 226/118.3 |
| 2006/0188312 | A1 * | 8/2006 | Ward | B41J 11/0025 | 400/613 |

* cited by examiner

TENSIONING MECHANISM FOR A TEXTILE FEED TO A STEPPED OPERATION DIGITAL TEXTILE PRINTER

FIELD AND BACKGROUND OF THE INVENTION

The present invention, in some embodiments thereof, relates to a tensioning mechanism for a textile feed to a stepped operation digital textile printer and, more particularly, but not exclusively, to such a textile printer that prints rolls of textile fabric.

Digital printers generally use a stepped feed. The material to be printed is advanced to a new position, the feed is stopped and the printer head prints the newly exposed material.

Stepped feeds have been used for printing on paper and like materials for many years. However, when feeding rolls of fabric, a problem arises in that the fabric overfeeds and thus becomes loose. Loose fabric is difficult to print on since part of the substrate may be hidden under a fold, and in any case, if the fabric is not taut, then the print will be uneven and distorted.

Fabric is fed along and adheres by a press roller to a 'tacky' conveyor belt. The feeding action is done by the conveyor belt that keeps pulling in new fabric as glued fabric moves tautly under the printheads. Then, after printing, the fabric is pulled away from the belt. The feeding action in digital machines is done in accurate steps. In each step the printing carriage prints across the fabric.

If wrinkles form on the 'tacky' belt, they can collide with the printheads, causing damage both to the printheads and the printing process.

In greater detail, there are woven fabrics that suffer from uneven internal tension from each edge of the fabric towards the center. Progressive increase in tension from each edge of the fabric towards the center portion is caused by progressive increase in the lengths of the threads from the center portion towards each edge. When a fabric of this character is fed into the press roller, slack may accumulate at the edges below the press roller. The slack may bunch and eventually create wrinkles that then pass the press roller.

Dealing with this common fabric quality issue is done by feeding the fabric to the press roller at higher tension. The increased tension stretches the slack fabric at the sides and thus may prevent the bunching phenomenon.

Increasing tension at the input to the press roller is accomplished by adding resistance to the fabric's motion created by the pulling of the 'tacky belt'.

Fabric resistance to the belt's pulling action is commonly provided in the course of digital printing. In most cases, the fabric is fed through a roll that resists spin due to a slip-clutch coupled to its shaft or by transferring the fabric through two round static bars creating high friction due to sharp wrapping angles.

These methods rely on building tension when the fabric is in motion and have no ability to contribute required tension between steps when no pulling action is carried out.

However, the stepped feed in digital printing machines makes it difficult to continuously maintain stable tension because deceleration and stopping of the press roller is not correlated with inertia of the fabric's motion.

Woven fabrics are usually not stretchable and for this reason they are more sensitive to small tension loss after every step. The tension loss may cause bunching of slack fabric at the sides.

SUMMARY OF THE INVENTION

The present embodiments insert a tension store into the feed mechanism of a stepped feed digital printer, which is tightened by the feed and releases to cause a pullback at the end of each feed to pull the fabric taut prior to the individual printing operations. Printing occurs in between feed steps, and the pullback may ensure that the fabric is re-tensioned as slack is taken up after each feed step, to allow even and accurate printing to occur. Feeding may be as rapid as necessary since any overfeed due say to imprecision in braking the momentum of the feed mechanism is retrieved by the pullback.

According to an aspect of some embodiments of the present invention there is provided a textile feed for a stepped operation digital textile printer, comprising a textile feeding mechanism configured to feed said textile in a forward direction onto said digital textile printer, said feeding mechanism being mechanically connected to a tension storage mechanism, such that forward motion of said feeding mechanism applies tension to said tension storage mechanism, said tension storage mechanism configured to release said tension to cause said feed mechanism to feed in a second, reverse direction after feeding in said forward direction, thereby to pull said fabric taut after said feeding in a forward direction.

In an embodiment, said textile feeding mechanism comprises a tensioning roller located in front of said digital textile printer.

In an embodiment, said tensioning roller is mechanically connected to said tension storage mechanism so that motion of said roller in said first, forward direction serves to add tension to said tension storage mechanism, and release of tension from said tension storage mechanism serves to drive said tensioning roller in said second, reverse direction.

In an embodiment, said tension storage mechanism comprises a drive mechanism and a spring, said spring being compressed by motion of said tensioning roller in said first, forward direction and release of said spring causing motion of said tensioning roller in said second, reverse direction.

In an embodiment, said tension storage mechanism comprises a drive mechanism and a pneumatic cylinder, said pneumatic cylinder being compressed by motion of said tensioning roller in said first, forward direction and release of said pneumatic cylinder after compression causing motion of said tensioning roller in said second, reverse direction.

An embodiment may comprise an arresting mechanism for holding said fabric at a forward feed position following feeding so that said pull in said second, reverse direction is prevented from reverse feeding said textile.

In an embodiment, said arresting mechanism comprises a sticky feed belt located forward of said tensioning roller.

An embodiment may comprise a first feed roller above and upstream of said tensioning roller and a second feed roller above and downstream of said tensioning roller but upstream of said digital textile printer, to feed said textile over said first feed roller, under said tensioning roller and over said second feed roller.

In an embodiment, said tensioning roller comprises a rotation axis and a gear wheel rotating with said rotation axis, to compress an energy reservoir.

In an embodiment, said gear wheel interlocks with a toothed linear track, said toothed linear track being linearly drivable by said gear wheel to compress an energy reservoir, and being linearly drivable by said energy reservoir to rotate said gear wheel to drive said tensioning roller in said second, reverse direction.

According to a second aspect of the present invention there is provided a method of stepped feeding of a roll of textile onto a digital printer and printing on said textile, the method comprising for each step of said stepped feeding:

feeding the textile in a first forward direction for a predetermined feeding length onto the digital printer;

during said feeding storing tension from the feeding motion in a tension reservoir;

at the end of said predetermined feeding length releasing said stored tension to exert a pull on said textile in a second reverse direction to pull said textile taut after said feeding.

The method may comprise holding said textile at a feed forward position following said feeding so that said pull is prevented from reverse feeding said textile.

The method may comprise feeding said textile via a tension roller, said tension roller being connected to said tension reservoir to store tension in said tension reservoir during said feeding motion.

In an embodiment, release of the stored tension causes said tension roller to be rolled back in said second reverse direction.

In an embodiment, a weight of said tension roller holds said fabric taut for a print duration.

The present embodiments encompass a textile, including a textile sheet, roll or garment or upholstery, printed according to the above described method or using the above-described apparatus.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
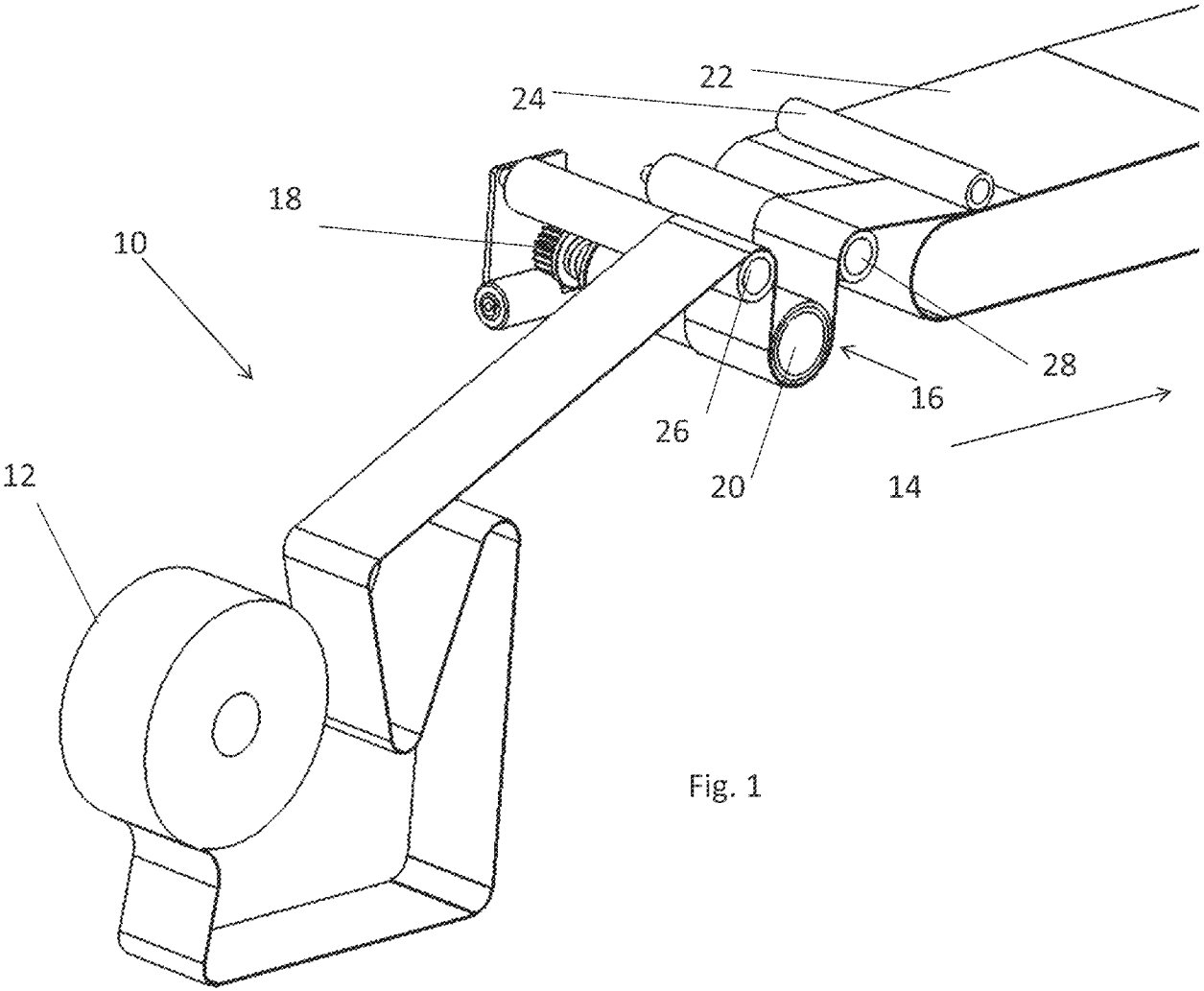
FIG. 1 is a simplified schematic diagram showing a textile feeder according to an embodiment of the present invention.

The present invention, in some embodiments thereof, relates to a tensioning mechanism for a textile feed to a stepped operation digital textile printer and, more particularly, but not exclusively, to a feeder for a textile printer that prints rolls of fabric.

The present embodiments may insert a tension into the feed mechanism, which causes a pullback at the end of each feed to take up any slack and pull the fabric taut prior to the individual printing operations.

The tension may be from a tensioning mechanism.

In one embodiment the feed works against a spring. The spring is tensioned by the feed step and then is released after the feed step to reverse the feeder mechanism and pull the fabric taut.

An alternative embodiment of the tensioning mechanism is a pneumatic cylinder. The cylinder is compressed by the feed step and then is released after the feed step to reverse the feeder mechanism, take up the slack in the same way and pull the fabric taut. The pneumatic cylinder or the spring act as energy reservoirs or tension reservoirs, storing energy from the forward motion of the feed and releasing the energy to provide a reverse motion to take up the slack of the textile.

In an embodiment the feeder mechanism comprises three rollers arranged in a triangle in front of the main printer feed belt. Two relatively small rollers are on either side of a larger central roller which extends below the relatively smaller rollers. The fabric is looped over the first small roller, under the larger roller and over the second small roller. The large roller is a tensioning roller and is attached to the tensioning mechanism to roll back after each feed.

The tensioning roller may be attached to a gear mechanism to tension the spring or pneumatic cylinder or other storage of tension during the feed step. At the end of the feed step the spring or cylinder pushes back on the gear mechanism to release the tension and in so doing causes the tensioning roller to roll backwards, thus picking up any slack on the fabric and ensuring that the fabric is tensioned for the next printing operation.

A torque limiter mechanism may be provided, which prevents further compression of the spring or cylinder.

In greater detail, as the fabric is pulled, the input shaft turns, causing the output shaft to turn around their common shaft. The output shaft is connected to a load that is capable of charging potential energy. The coupling of the input shaft to the output shaft is done by a torque limiter which is adjusted according to the required fabric tension. At the point where the desired torque is reached, potential energy is already charged while the input shaft may still be spinning and the output shaft may have stalled. The amount of potential energy stored is relative to the magnitude of the torque limitation.

After each step, when the fabric ceases to be pulled any more at the preset limited torque, tension loss occurs. Loss of fabric tension immediately reduces the torque that preserves the stored potential energy. The stored potential energy may be converted back to torque which may start turning the output shaft backwards to again match the torque limit.

This way the input shaft may turn backwards through the torque limiter and restore the desired tension to eliminate slack.

The mechanism action is dynamic, holding a stable desired tension thought the stepping motion of the fabric.

An advantage of embodiments of the invention is a cushioning effect on fabric tension at the acceleration phase. The cushioning effect is achieved because when the input shaft accelerates, the output shaft accelerates at the same rate below the torque threshold value. The fabric advances at high acceleration before the output shaft stalls and a torque threshold value may then be achieved without overshooting. A common torque limiter may cause a tension impact when pulling the fabric from a static state.

High acceleration may over-tension the fabric which may disturb the adhesion quality of the fabric to the tacky belt. Subsequently, portions of over-tensioned fabric may lose grip with the tacky belt before the printing stage, thus disturbing the printing process. Over-tensioning the fabric may also cause it to deform or tear. Gentle and lower accelerations may also serve to eliminate over-tensioning but at the cost of slowing down the whole printing process.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 is a simplified schematic diagram which illustrates a textile feed 10 for feeding a roll of textile 12 onto a stepped operation digital textile printer located beyond the feeder in the direction of arrow 14.

The textile feed comprises a textile feeding mechanism 16, and a tension storage mechanism 18 which is shown and discussed below. The tension storage mechanism 18 is partly obscured in FIG. 1 but is shown in greater detail in later figures. The feeder 10 feeds the textile 12 in a forward direction indicated by arrow 14 onto the digital textile printer. As will be explained below, the feeding mechanism 16 is mechanically connected to the tension storage mechanism 18 and the tension storage mechanism is tensioned by the forward feeding. The tension storage mechanism thus gets tensioned by the forward feed and at the end of the forward feed the tension is released to push the feeding mechanism backwards. That is, the released tension causes the feed mechanism 16 to bounce back, to feed momentarily in a second, reverse direction. The reverse has the effect of pulling the fabric taut and thus gathering up any slack after the feed forward step. The fabric is thus under tension after the feed to allow effective digital printing onto the fabric by the printer.

The textile feeding mechanism 16 comprises a tensioning roller 20 which is located to feed the textile onto conveyor belt 22 which conveys the textile to the digital textile printer.

Press roller 24 presses down on the textile to adhere the textile to the conveyor which is typically sticky.

The feeding mechanism 16 further comprises upstream and downstream guide rollers 26 and 28, located above and on either side of the tensioning roller 20. The textile is fed over guide roller 26, under tensioning roller 20 and then over guide roller 28 to approach the conveyor belt 22.

Figure 2:
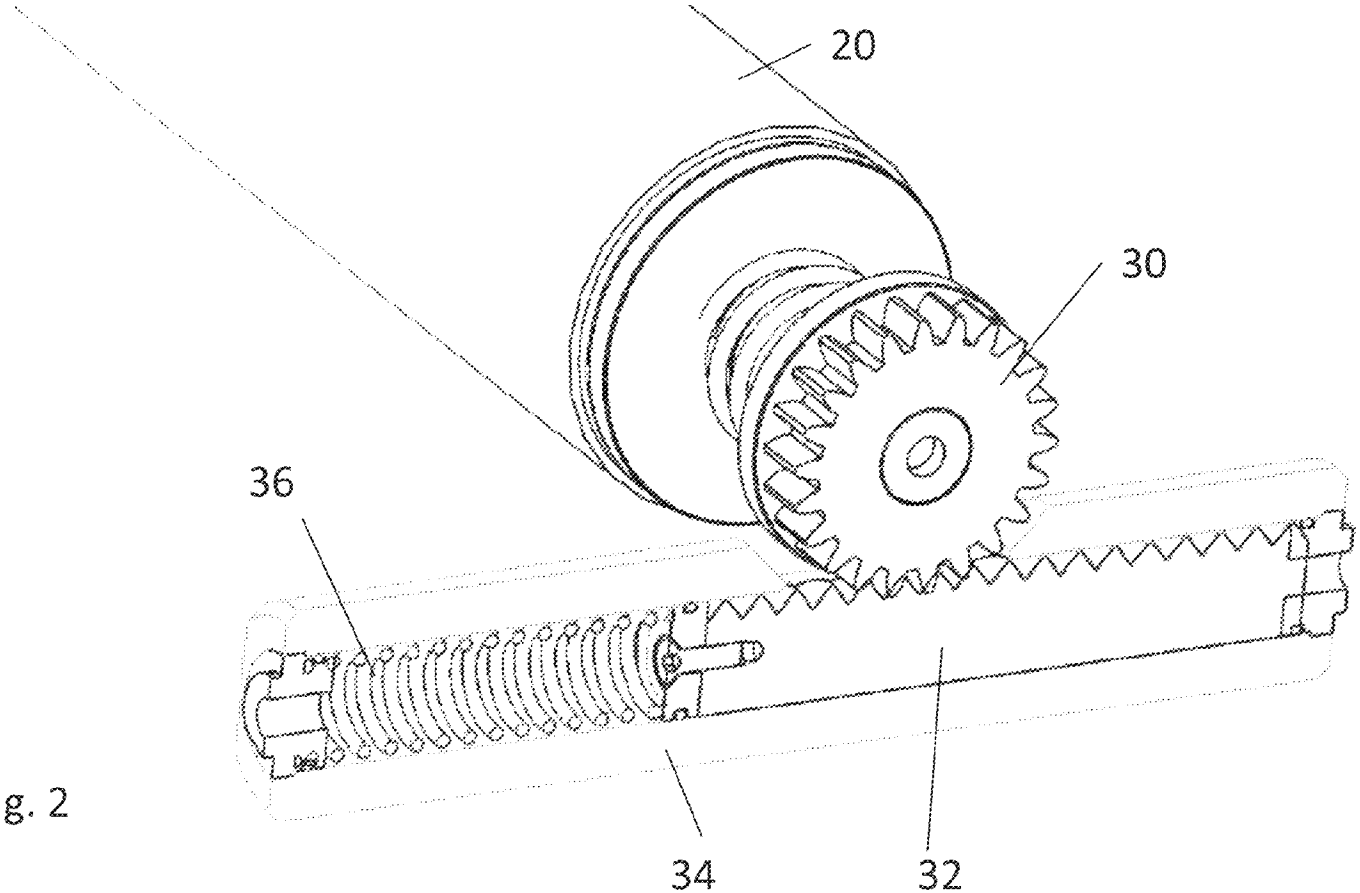
FIG. 2 is a simplified cutaway cross-sectional diagram showing a detail of the textile feeder of FIG. 1.

Reference is now made to FIG. 2, which is a simplified cross-sectional cutaway diagram showing one end of the tensioning roller and an example of the tension storage mechanism 18 according to an embodiment of the present invention. Roller 20 includes a coaxial gear wheel 30 which interlocks with a linear geared track 32. The geared track extends into a tension storage device 34, which in this case comprises coiled spring 36. As the gear wheel 30 rotates in the clockwise direction the linear track 32 is pushed into the spring 36 to compress the spring. At the end of a feed step, as the roller 20 ceases to be driven, the spring 36 pushes back on the track which in turn rotates the gearwheel in the anti-clockwise direction, acting against the momentum of the roller 20 and pushing the tensioning roller 20 into reverse. The action of the spring may be in addition to any other braking mechanism applied to the roller 20 to end the feed step.

Thus the tensioning roller is mechanically connected to the tension storage mechanism so that motion of the roller in the forward feeding direction tensions the tension storage mechanism. The tension storage mechanism then drives the tensioning roller in the reverse direction.

Figure 3:
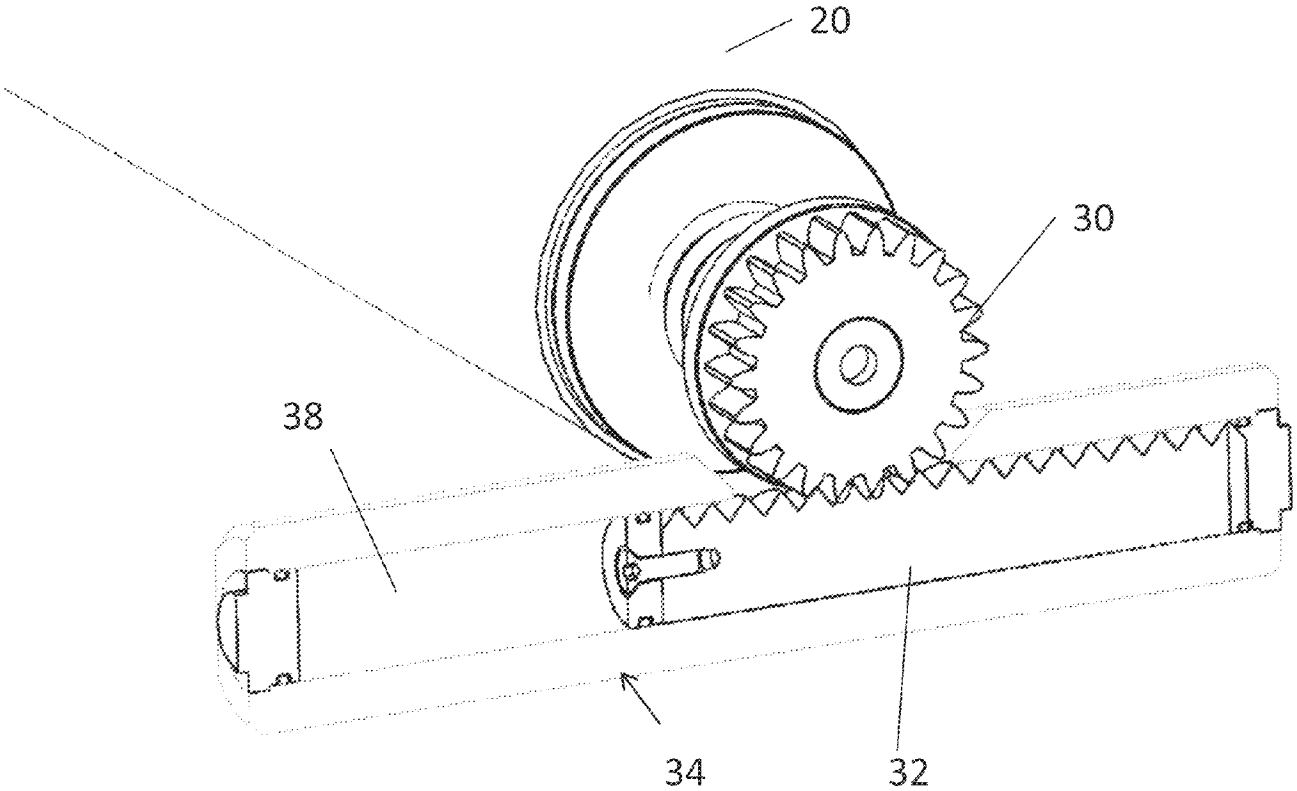
FIG. 3 is a simplified cutaway cross-sectional diagram showing a detail of the textile feeder of FIG. 1 according to an alternative to the version shown in FIG. 2.

Reference is now made to FIG. 3, which is a simplified cross-sectional cutaway diagram illustrating a variation of the tensioning storage mechanism of FIG. 2. Roller 20 comprises a coaxial gear wheel 30 which interlocks with a linear geared track 32 as before. The geared track extends into a tension storage device 34, which in this case comprises pneumatic cylinder 38. As the gear wheel 30 rotates in the clockwise direction the linear track 32 is pushed into the cylinder 38 to compress the cylinder and the air inside, thus storing tension. At the end of a feed step, the roller ceases to rotate and cylinder 38 pushes back on the track which in turn rotates the gearwheel in the anti-clockwise direction, pushing the tensioning roller 20 into reverse.

Thus, as before, the tensioning roller is mechanically connected to the tension storage mechanism so that motion of the roller in the forward feeding direction tensions the tension storage mechanism. The tension storage mechanism then drives the tensioning roller in the reverse direction.

Figure 4:
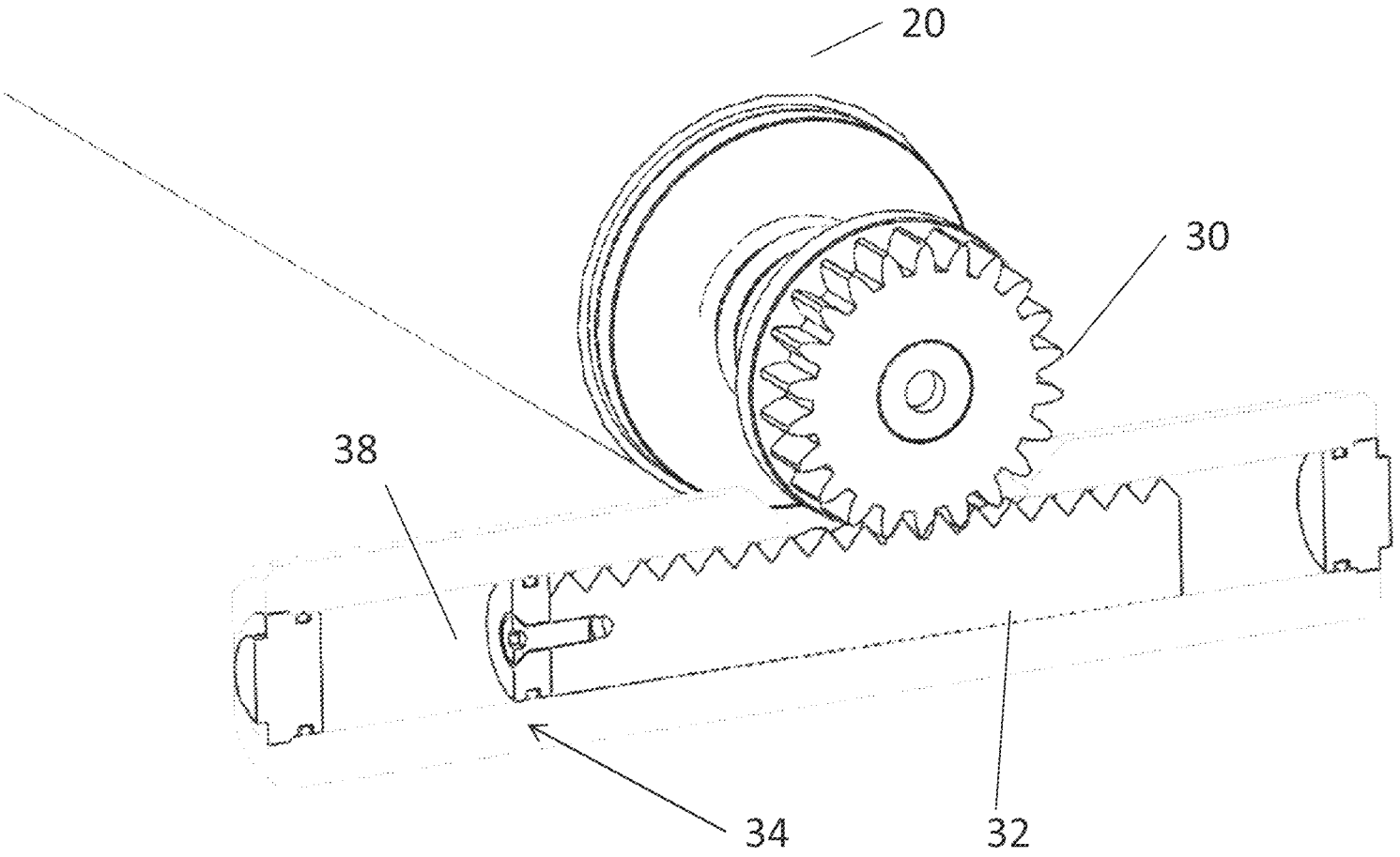
FIG. 4 is a simplified cutaway cross-sectional diagram showing the detail of FIG. 3 under compression.

Reference is briefly made to FIG. 4, which illustrates the tension storage mechanism of FIG. 3 with the pneumatic cylinder compressed by the linear track 32.

In FIG. 4, the cylinder has advanced to the left under influence of the gear wheel 30, when compared with the FIG. 3 position, thus compressing the gas in the cylinder and storing the tension for a reversal.

Figure 5:
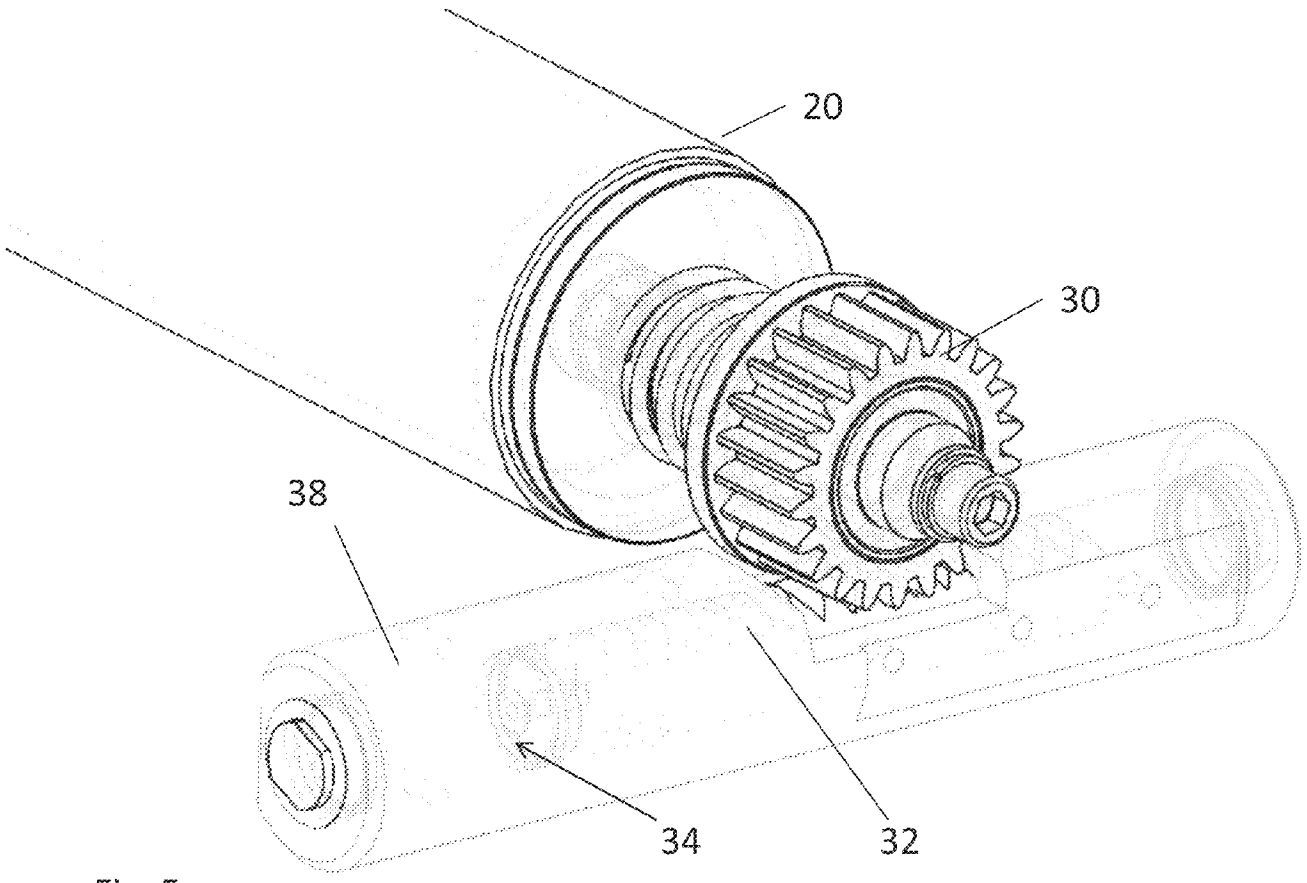
FIG. 5 is a simplified isometric diagram showing the detail of FIG. 3.

Reference is now made to FIG. 5, which is an isometric view of the tension storage mechanism of FIG. 3. Identical parts are given the same reference numerals as in FIG. 3 and FIG. 4 and are not referred to again except as needed for the present understanding. As shown, the linear track is enclosed in a casing 40. The casing has an opening 42 at the location of the gear wheel 30 to provide the gear wheel with access to the linear track.

Figure 6:
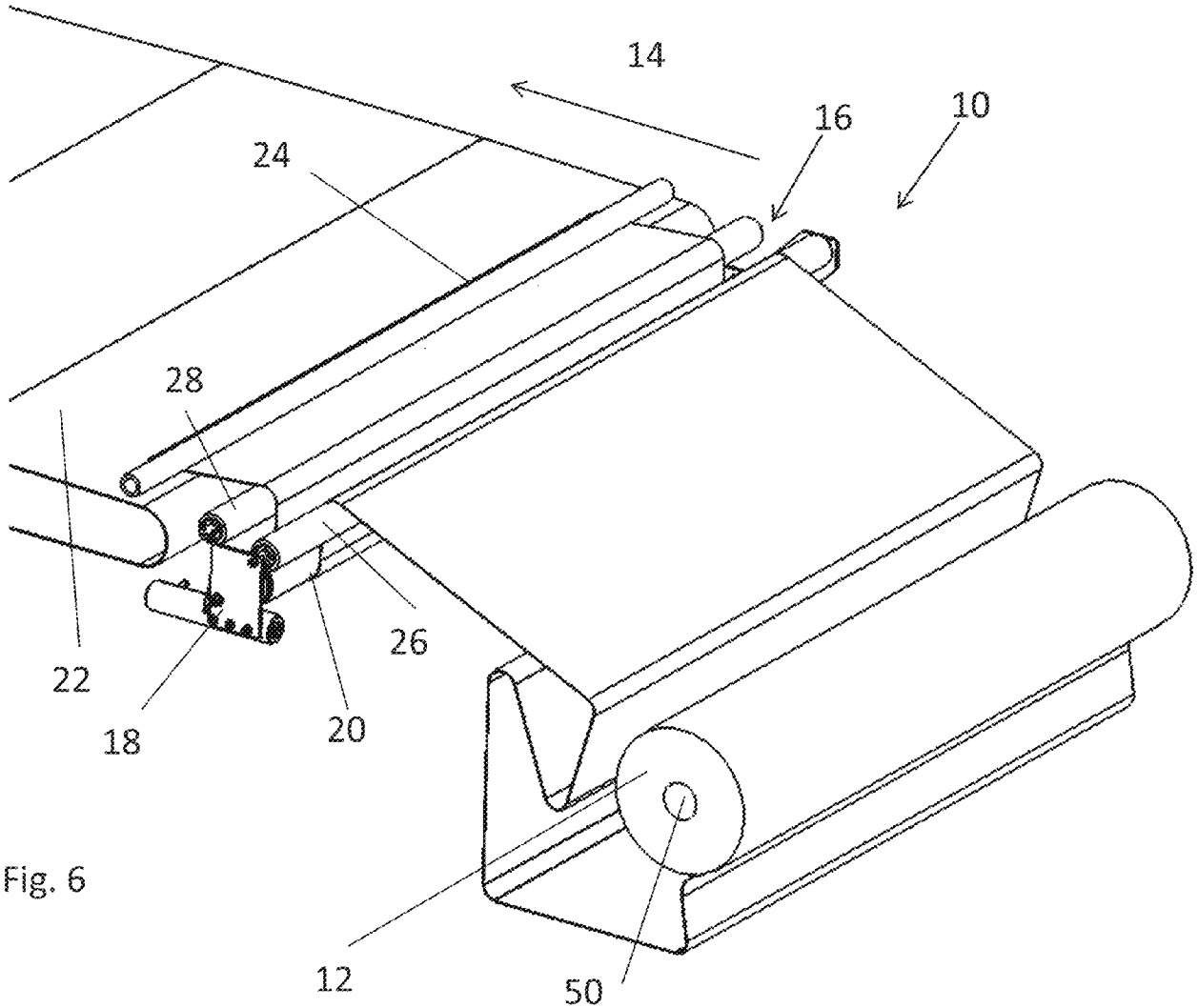
FIG. 6 is a simplified schematic isometric diagram illustrating the feeder of FIG. 1 from the side of the tension storing mechanism.

Reference is now made to FIG. 6 which is a perspective view of the fabric feeder 10. The roll of fabric 12 to be fed to the printer is mounted on a rotatable axis 50, and fed via a sequence of guide rollers shown merely as turns in the textile, to the feed mechanism 16. The textile is fed over upstream guide roller 26, under tensioning roller 20, over downstream guide roller 28 and onto belt 22 where it passes under press roller 24. The belt 22 may be sticky and the press roller 24 presses the fabric down onto the sticky surface.

As discussed before, feeding is carried out in feed steps. At each step a new width of the textile equivalent to the width of the print heads and the print area is exposed for printing and the idea is that the fabric exposed for printing is held taut so that the printing can be carried out evenly on the textile fabric. Thus, as explained, each step forward in the direction of arrow 14 tensions or winds up the tension storage mechanism. At the end of the feed step the tension is released pushing the tensioning roller in the opposite direction. As the textile is held between the press roller and the preferably sticky belt, the textile is not in fact fed in the reverse direction but rather is tensioned. Thus the textile exiting the press roller 24 in the direction of arrow 14 is maintained tight, with the help of the stickiness of the belt 22 and the print area remains taut.

Thus the combination of the sticky belt and the flattening roller provide an arresting mechanism for holding the fabric at the forward feed position following feeding so that the pull in the reverse direction is prevented from reverse feeding the textile but rather takes up slack and keeps the textile taut.

In one embodiment the tensioning roller 20 continues to operate the gear wheel 30 as long as it rotates. As long as all motion is in small steps all is well. However occasionally there is a need to feed the fabric in larger steps. The larger steps may cause too much compression and risking damage to the gearing components. Thus a rotation stop device (not shown) may be inserted between the roller 20 and gear wheel 30 to prevent forward rotation when the tension exceeds a predetermined maximum value.

The pull of the now-taut fabric on the tension roller may help to arrest the reverse motion of the tension roller before the next feed step.

Figure 7:
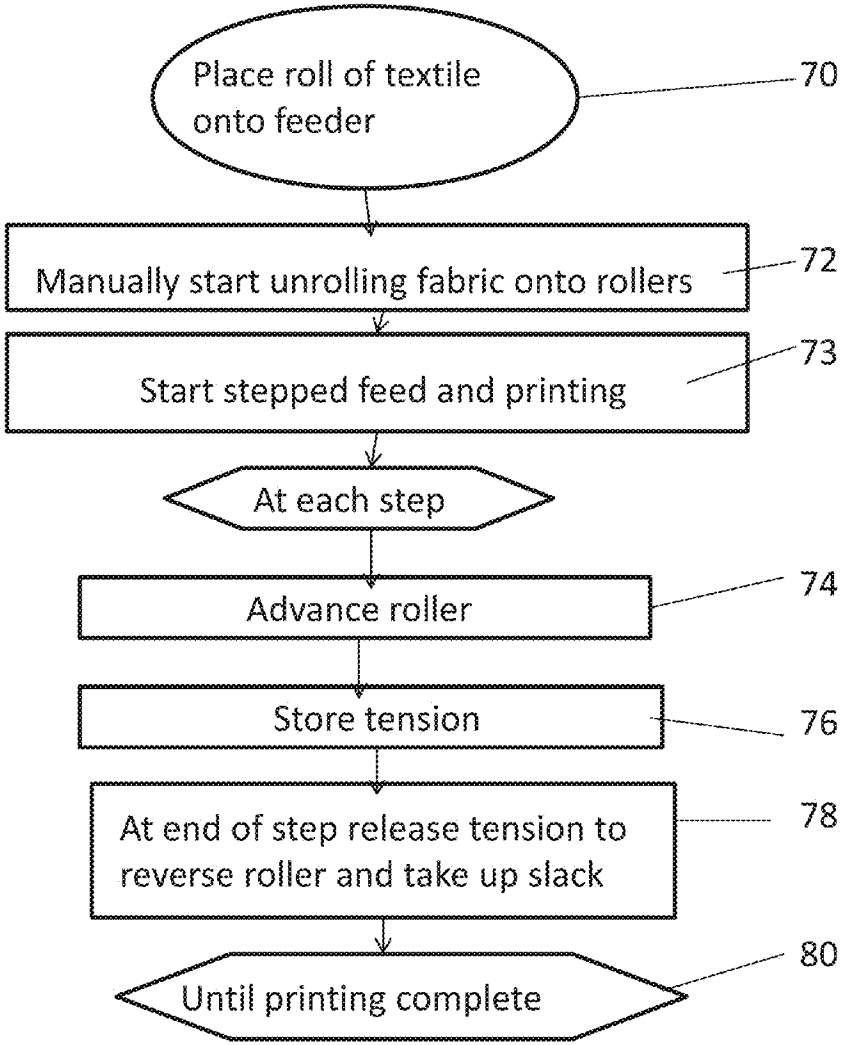
FIG. 7 is a simplified flow diagram illustrating a method of textile feeding according to embodiments of the present invention.

Reference is now made to FIG. 7, which is a simplified flow chart of a method of stepped feeding of a roll of textile onto a digital printer. The roll 12 is placed on the feeder—box 70 and the start of the textile fabric is unrolled to be positioned on the rollers of the feeder—box 72. Then the textile is step fed into the printer for printing—box 73. For each step of the stepped feeding, the textile is fed in the forward direction to expose a printing width on the digital printer by advancing the rollers in the forward direction—box 74. As the rollers advance, tension is stored in the storage mechanism—box 76. At the end of the step, the rollers stop advancing and the storage mechanism is able to release the tension to force the rollers to roll back and take up the slack—box 78. Thus the textile is kept taut at all times during the printing process. The process is continued in stepwise manner until printing is completed—box 80.

Figure 8:
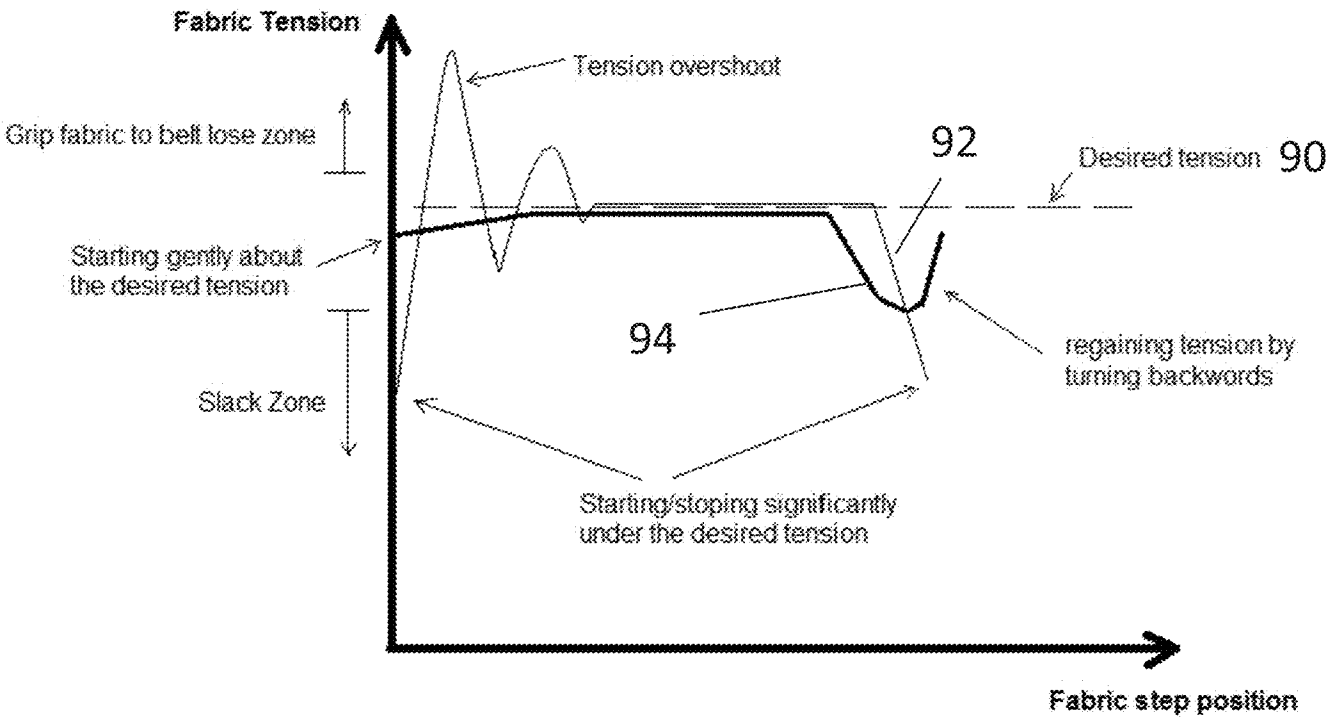
FIG. 8 is a simplified graph showing fabric tension against fabric step position during the course of a feed step of the fabric.

Reference is now made to FIG. 8, which is a simplified diagram illustrating the fabric step position against tension in the fabric over the course of a feed step. The idea is to keep the fabric at a desired tension indicated by line 90. Above line 90 the fabric may not be correctly gripped by the sticky belt and may come lose. Below the line 90 there is slack.

Line 92 indicates the tension levels using the prior art. At the start of the step there is a region of damped vibration between overtension and undertension. At the end of the step there is a significant drop in tension leading to considerable slack.

Line 94 indicates the tension levels with the use of the present embodiments.

There is no overshoot as the step begins gently with the desired tension. At the end of the step the tension drops but then is regained as the roller is turned backwards.

Figure 9:
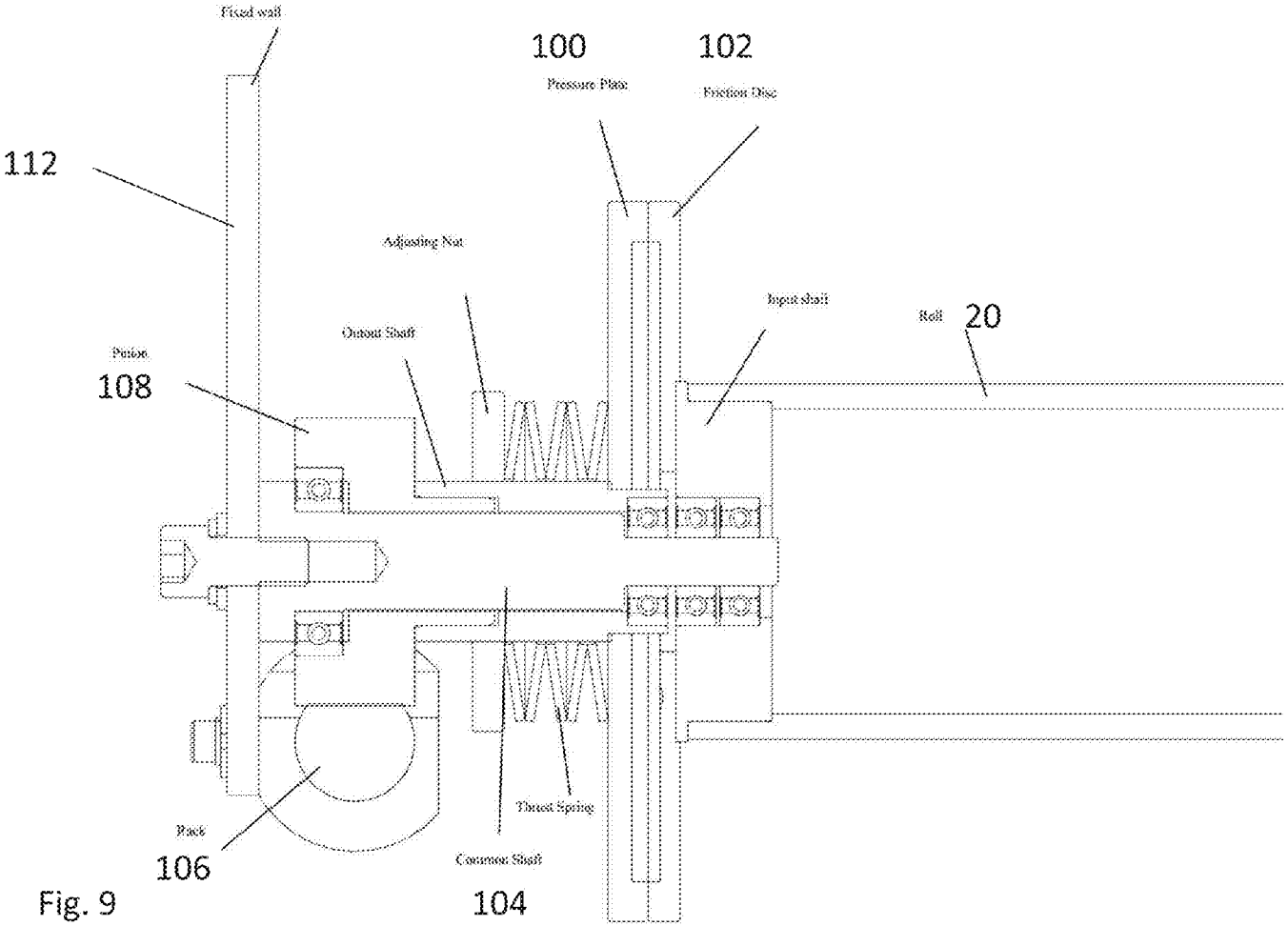
FIG. 9 is a side view of the tension storage according to a further embodiment of the present invention.

Reference is now made to FIG. 9 which is a view of an embodiment of the present invention in which a friction disc serves as a torque limiter. Roll 20 as before tensions the fabric before the input. Pressure plate 100 and friction disc 102 couple roll 20 to shaft 104 that operates a rack 106 and pinion 108. Side wall 112 keeps the parts fixed in position.

Figure 10:
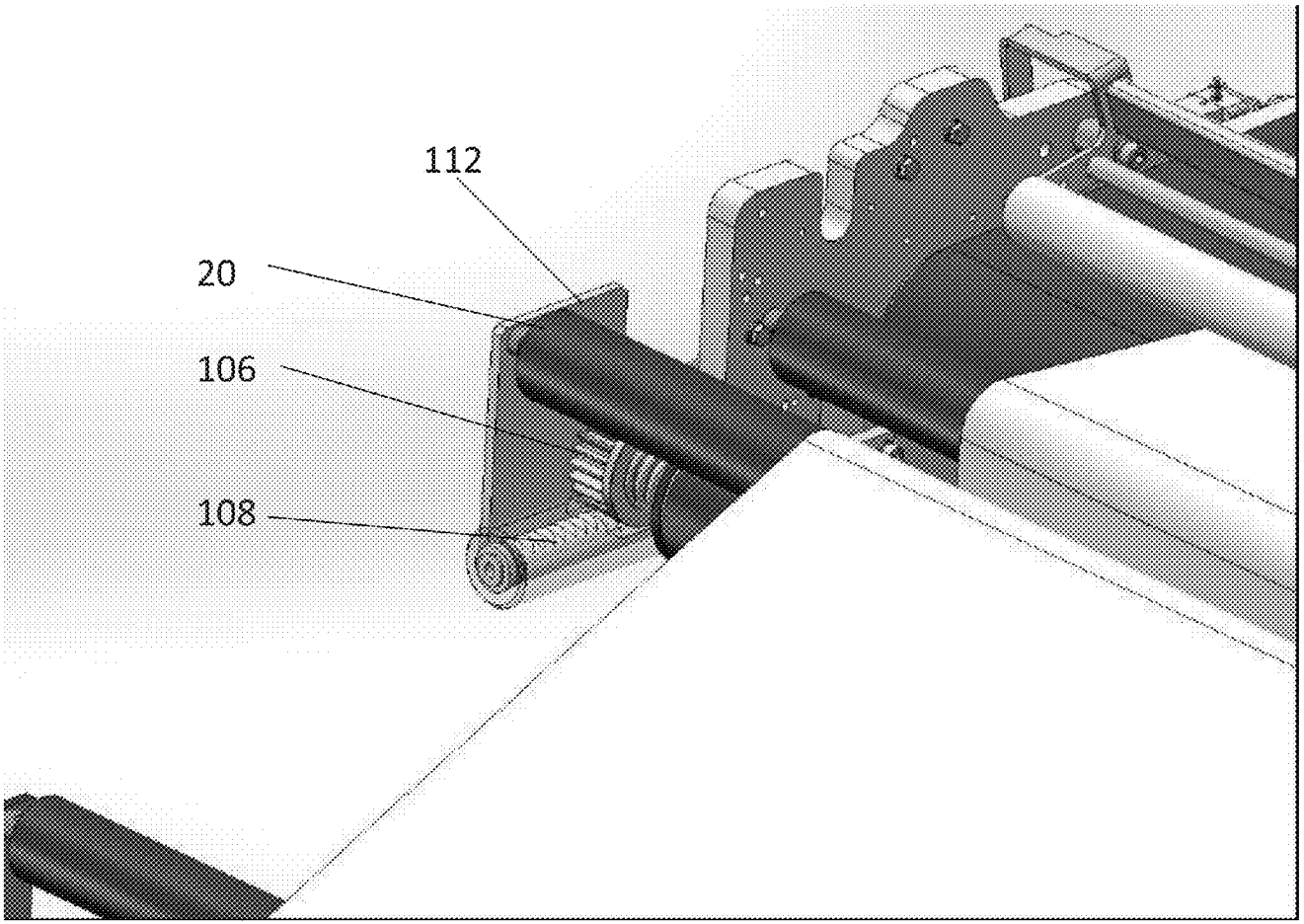
FIG. 10 is a perspective view of the embodiment of FIG. 9 with textile being fed.

Reference is now made to FIG. 10, which is a simplified perspective drawing showing the rack 106 and pinion 108 of FIG. 9.

Figure 11:
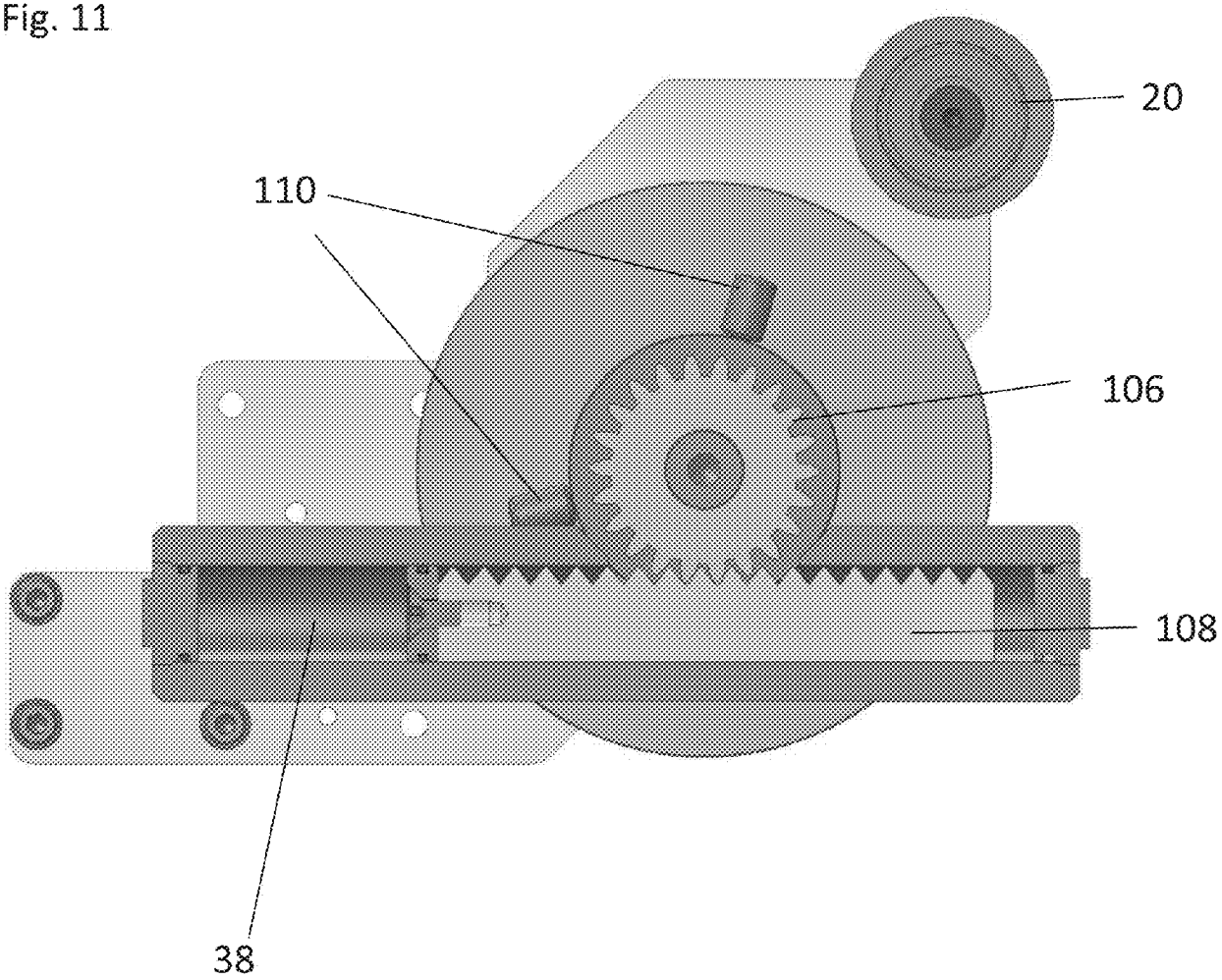
FIG. 11 is an end view of the embodiment of FIG. 9 with a spring used as the energy storage.

FIG. 11 is a side view, showing rack 106 and pinion 108, operating to compress cylinder 38. In the embodiment of FIG. 11 rotation stoppers 110 prevent the rack from over-rotating.

Figure 12:
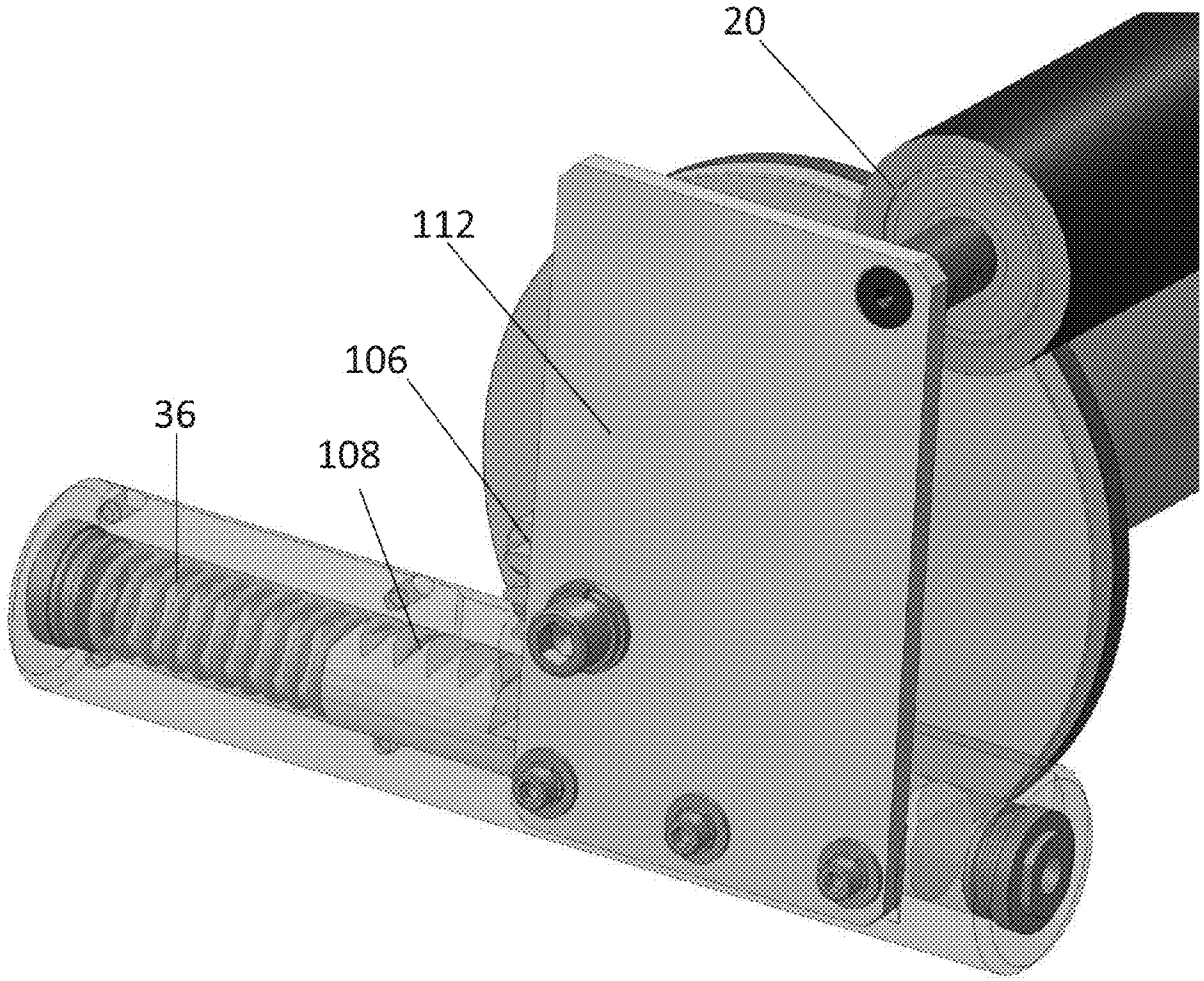
FIG. 12 is a variation of the embodiment of FIG. 11 where a pneumatic cylinder is used as the energy storage.
Figure 13:
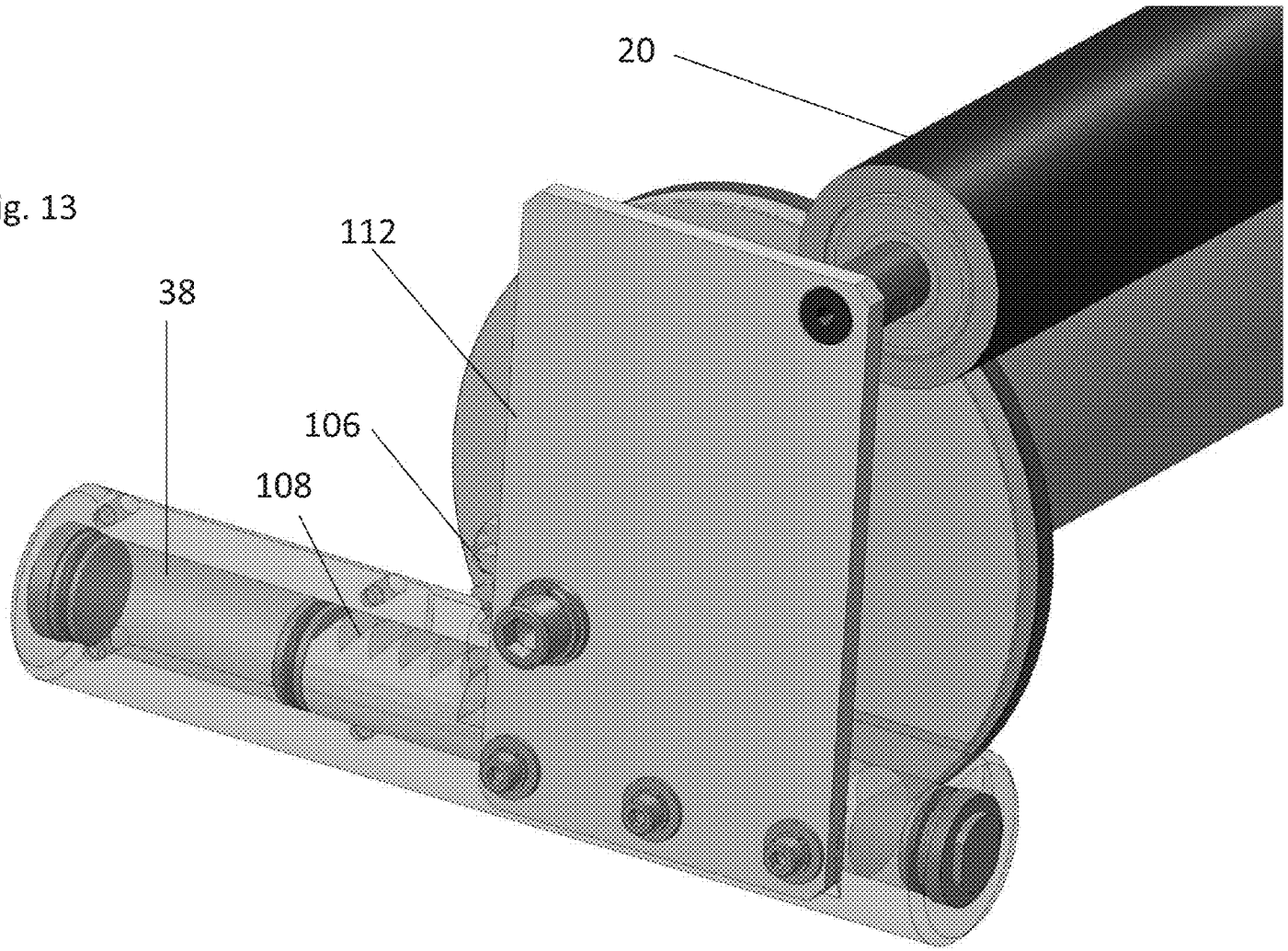
FIG. 13 is an end perspective view of the embodiment of FIG. 12.

In FIGS. 12 and 13 a side perspective view is shown in which the rack 106 is partially obscured behind fixed wall 112. In FIG. 12 the tension is stored in spring 36.

In FIG. 13, the tension is stored in pneumatic cylinder 38.

Figure 14:
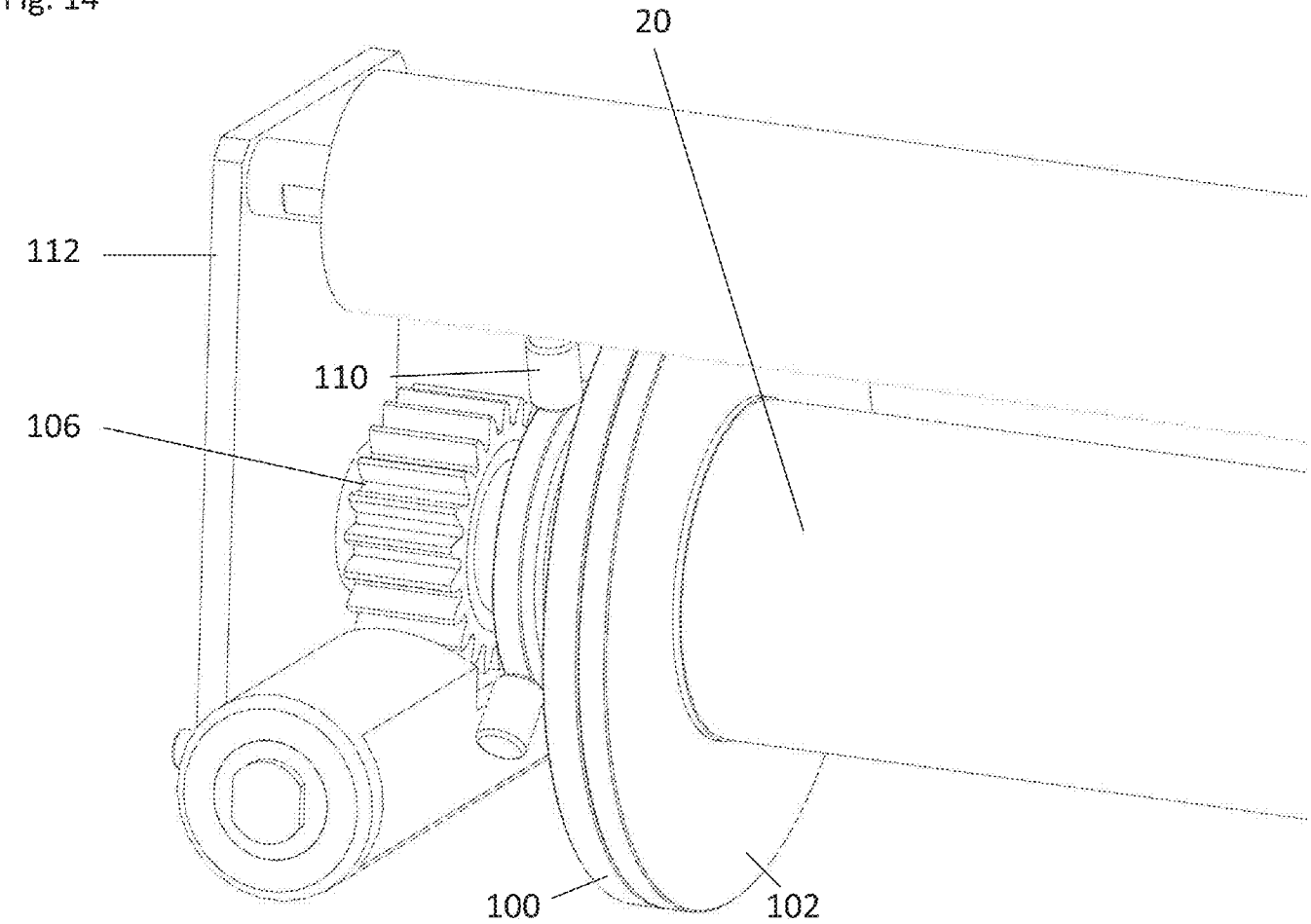
FIG. 14 is a side perspective view of the embodiment of FIG. 9.

FIGS. 14, 15, 16, 17, 18 and 19 show the embodiment of FIG. 9 from different angles. FIG. 14 shows the roll 20 as before which tensions the fabric before the input.

Figure 15:
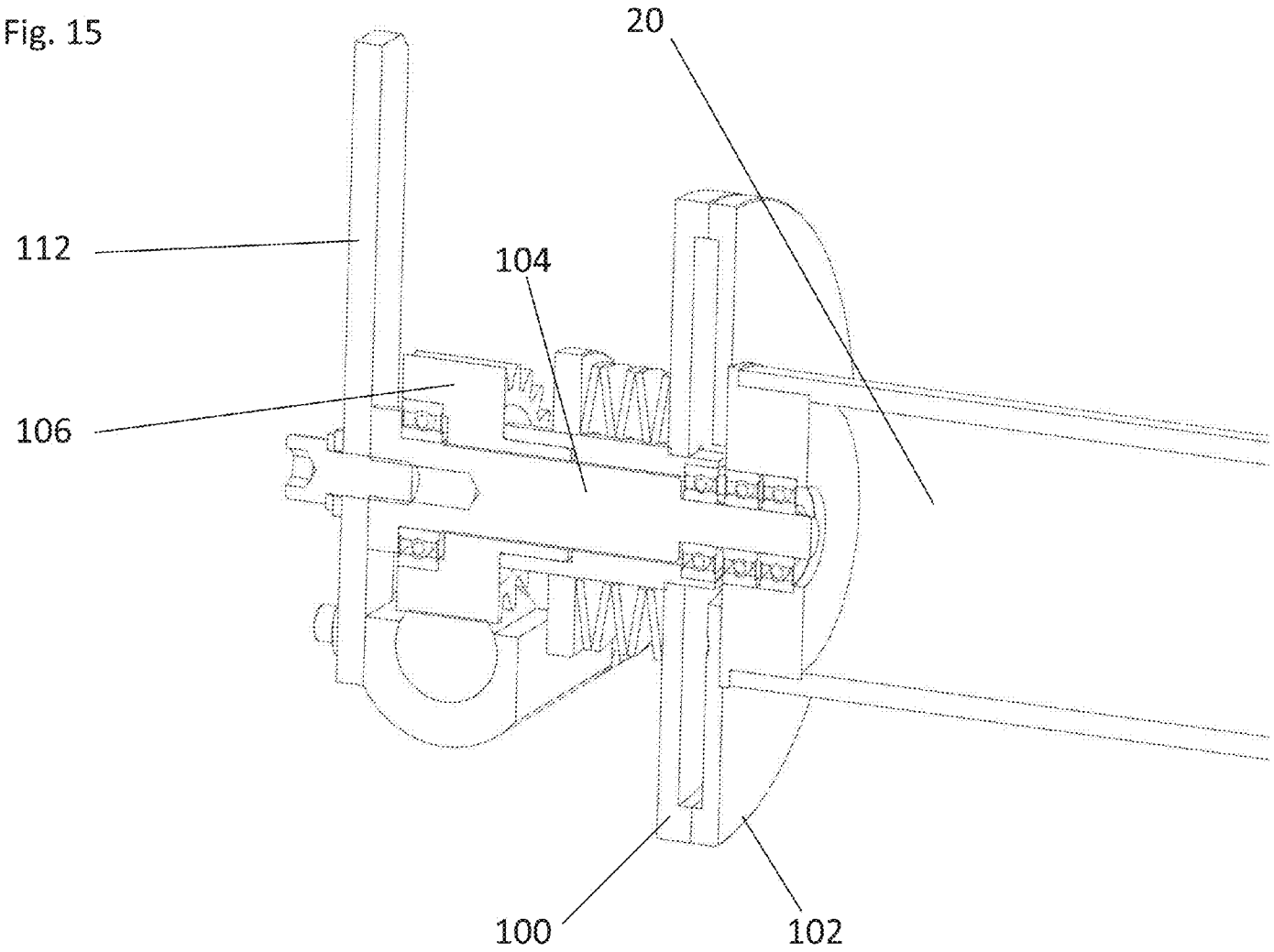
FIG. 15 is a side cutaway view of the embodiment of FIG. 9.
Figure 16:
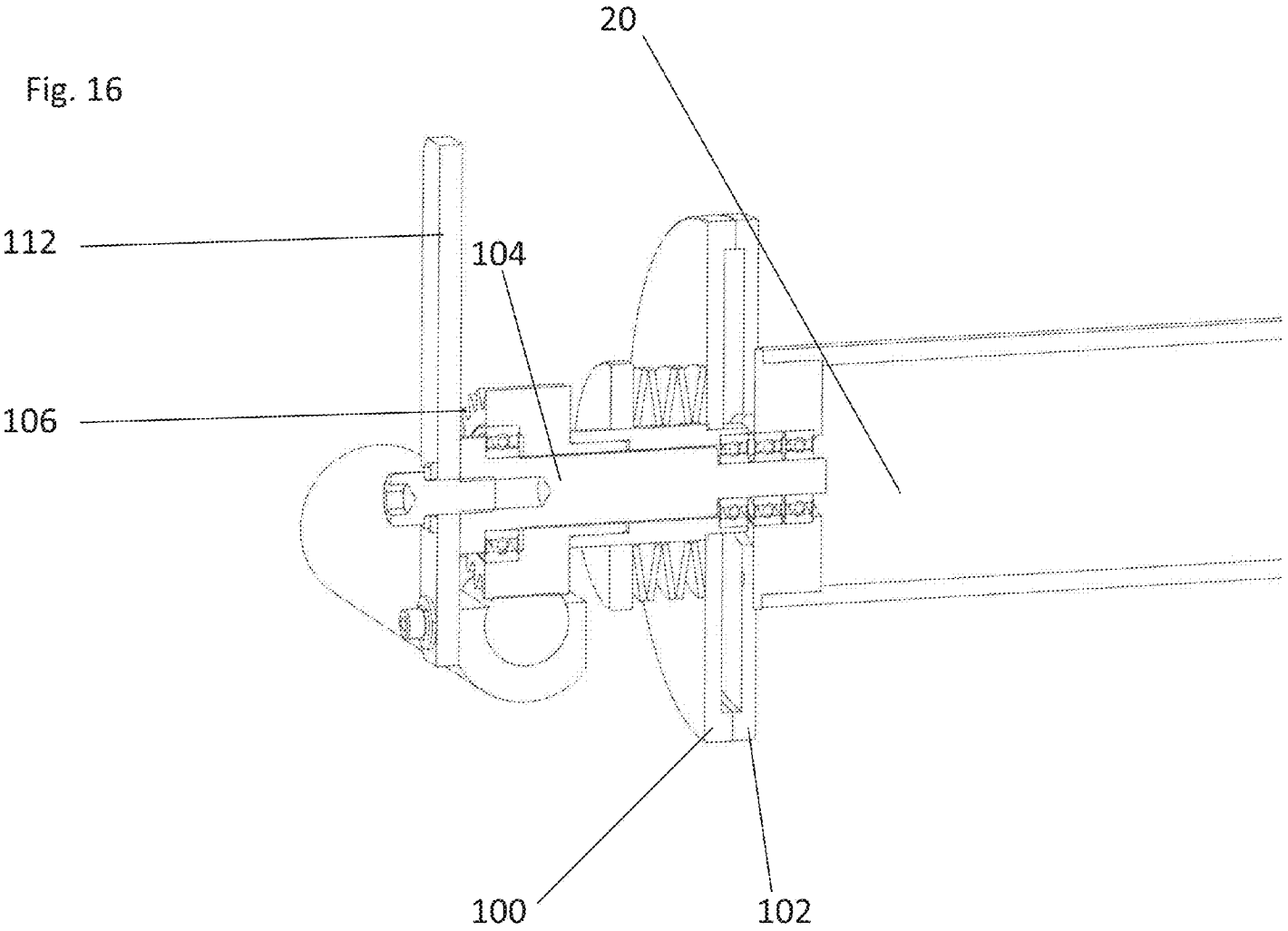
FIG. 16 is the cutaway view of FIG. 15 from a different angle.
Figure 17:
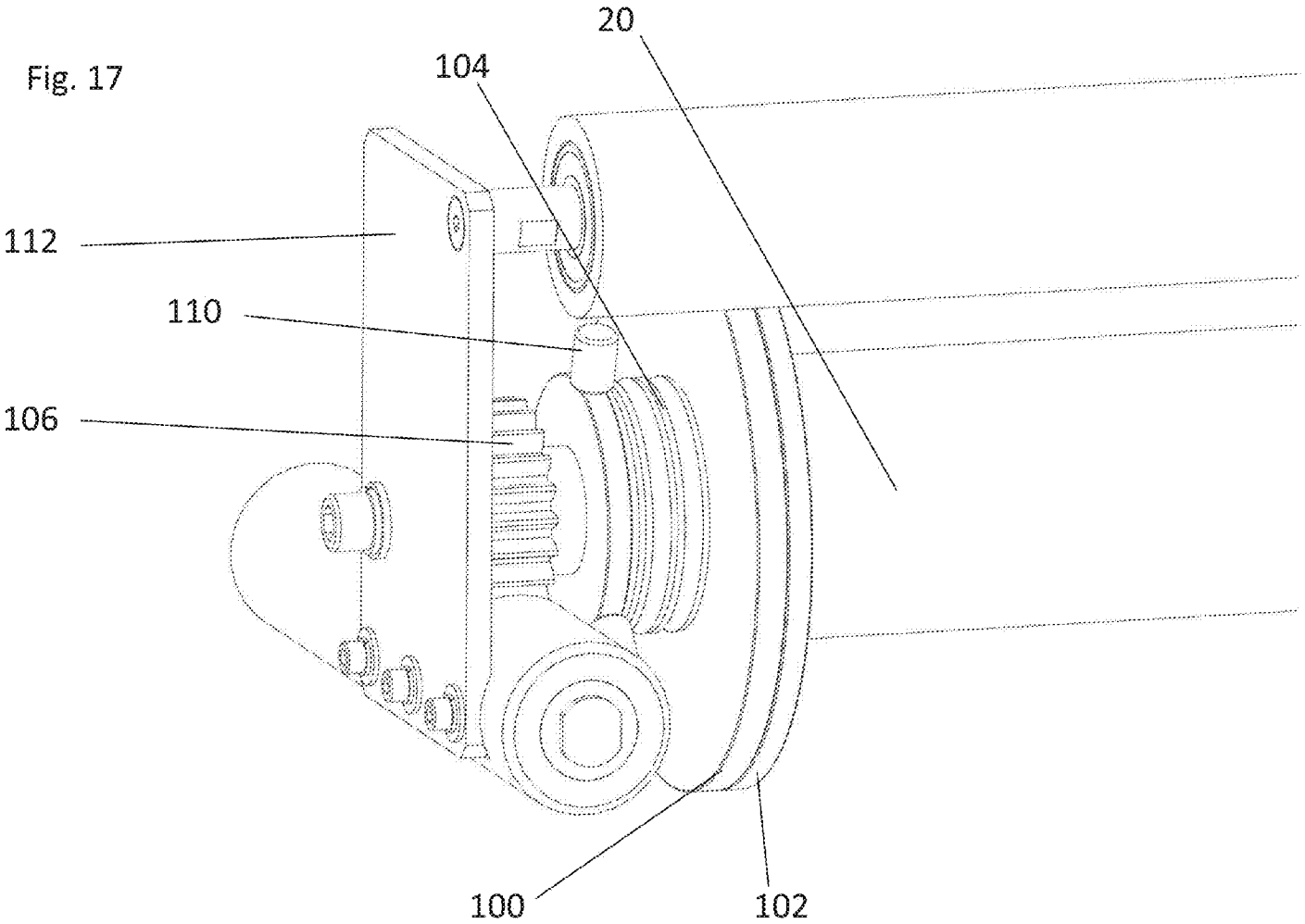
FIG. 17 is a perspective view of the energy storage mechanism of the embodiment of FIG. 9.
Figure 18:
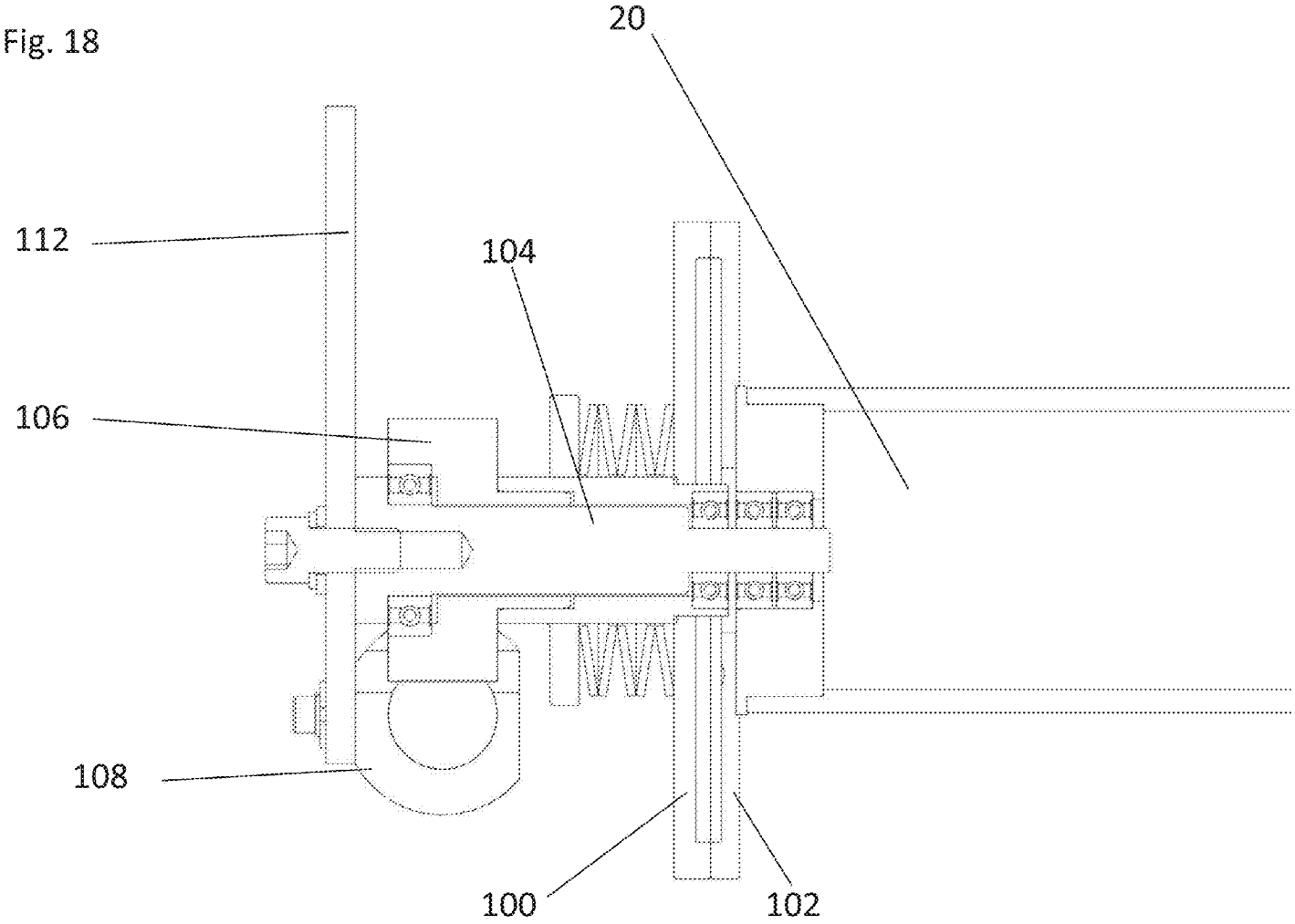
FIG. 18 is a cross-sectional detail of the energy storage mechanism of embodiment of FIG. 9.
Figure 19:
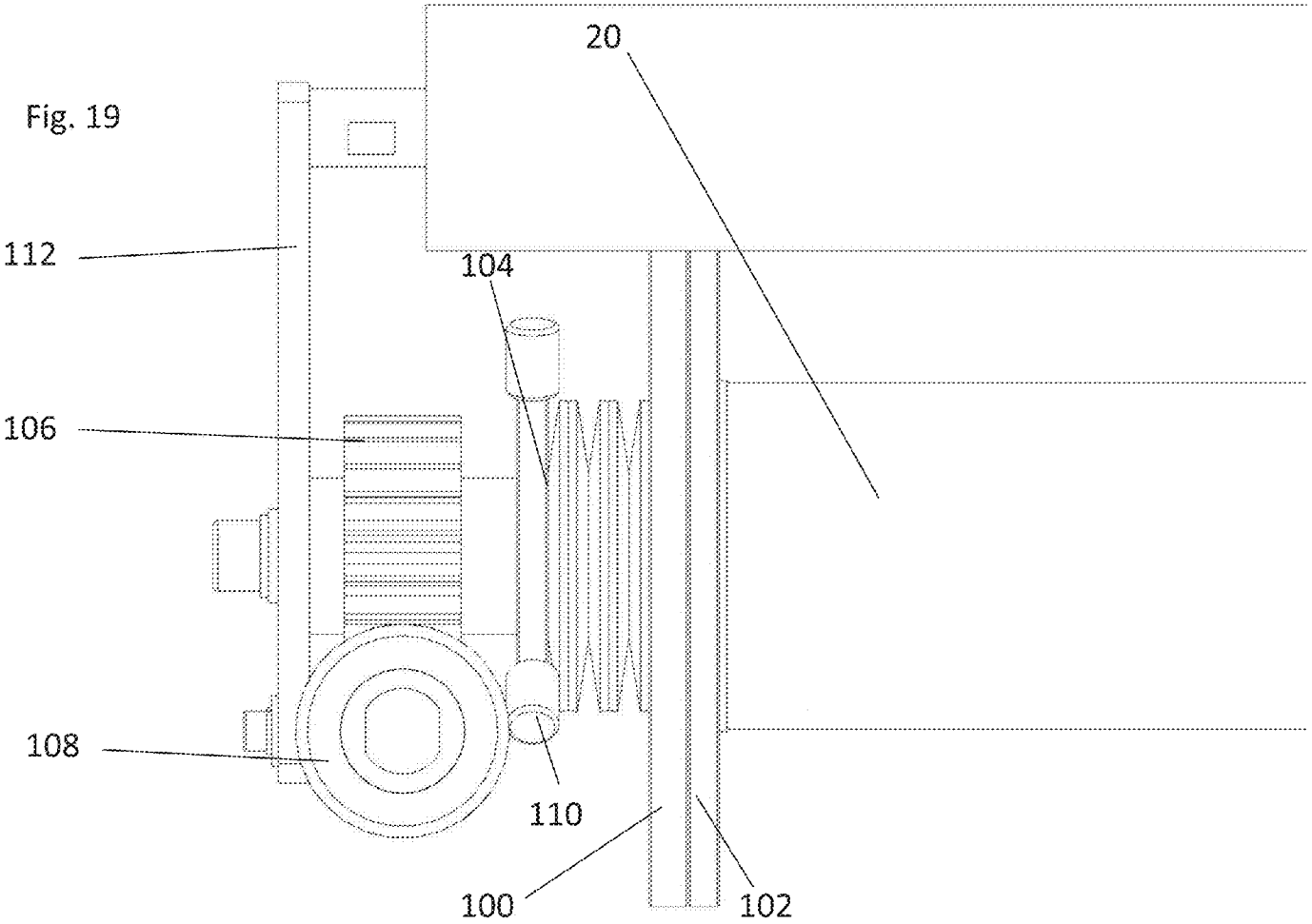
FIG. 19 is a side view of the detail of FIG. 18.

Pressure plate 100 and friction disc 102 couple roll 20 to shaft 104 (not shown) that operates a rack 106 and pinion 108. Side wall 112 keeps the parts fixed in position. FIG. 15 is a cutaway view of the same. FIG. 16 is a cutaway view from a different angle. FIG. 17 is a side perspective view. FIG. 18 is a side cross-sectional view. FIG. 19 is a side view of the same.

It is expected that during the life of a patent maturing from this application many relevant textile printing technologies will be developed and the scope of the term textile printing is intended to include all such new technologies a priori.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment, and the above description is to be construed as if this combination were explicitly written. Conversely, various features of the invention, which are, for brevity, described in the context of a single embodiment, may also be provided separately or in any suitable subcombination or as suitable in any other described embodiment of the invention, and the above description is to be construed as if these separate embodiments were explicitly written.

Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A textile feed for a stepped operation digital textile printer, comprising a textile feeding mechanism configured to feed said textile in a forward direction onto said digital textile printer, said feeding mechanism being mechanically connected to a tension storage mechanism, such that forward motion of said feeding mechanism applies tension to said tension storage mechanism, said tension storage mechanism configured to release said tension to cause said feed mechanism to feed in a second, reverse direction after feeding in said forward direction, thereby to pull said fabric taut after said feeding in a forward direction, wherein said tension storage mechanism comprises a drive mechanism and a spring, said spring being compressed by motion of said tensioning roller in said first, forward direction and release of said spring causing motion of said tensioning roller in said second, reverse direction, the feed mechanism further comprising an arresting mechanism for holding said fabric at a forward feed position following feeding so that said pull in said second, reverse direction is prevented from reverse feeding said textile.

2. The textile feed of claim 1, wherein said textile feeding mechanism comprises a tensioning roller configured for location at a feeding side of said digital textile printer.

3. The textile feed of claim 2, wherein said tensioning roller is mechanically connected to said tension storage mechanism so that motion of said roller in said first, forward direction serves to add tension to said tension storage mechanism, and release of tension from said tension storage mechanism serves to drive said tensioning roller in said second, reverse direction.

4. The textile feed of claim 2, wherein said tension storage mechanism comprises a drive mechanism and a pneumatic cylinder, said pneumatic cylinder being compressed by motion of said tensioning roller in said first, forward direction and release of said pneumatic cylinder after compression causing motion of said tensioning roller in said second, reverse direction.

5. The textile feed of claim 2, further comprising a first feed roller above and upstream of said tensioning roller and a second feed roller above and downstream of said tensioning roller but upstream of said digital textile printer, to feed said textile over said first feed roller, under said tensioning roller and over said second feed roller.

6. The textile feed of claim 2, wherein said tensioning roller comprises a rotation axis and a gear wheel rotating with said rotation axis, to compress an energy reservoir.

7. The textile feed of claim 6, wherein said gear wheel interlocks with a toothed linear track, said toothed linear track being linearly drivable by said gear wheel to compress an energy reservoir, and being linearly drivable by said energy reservoir to rotate said gear wheel to drive said tensioning roller in said second, reverse direction.

8. The textile feed of claim 1, wherein said arresting mechanism comprises a sticky feed belt located forward of said tensioning roller.

9. A method of stepped feeding of a roll of textile onto a digital printer and printing on said textile, the method comprising for each step of said stepped feeding:

feeding the textile in a first forward direction for a predetermined feeding length onto the digital printer;

during said feeding storing tension from the feeding motion in a tension reservoir;

at the end of said predetermined feeding length releasing said stored tension to exert a pull on said textile in a second reverse direction to pull said textile taut after said feeding;

arresting said fabric at a forward feed position following feeding so that said pull in said second, reverse direction is prevented from reverse feeding said textile.

10. The method of claim 9, comprising feeding said textile via a tension roller, said tension roller being connected to said tension reservoir to store tension in said tension reservoir during said feeding motion.

11. The method of claim 10, wherein said releasing said stored tension causes said tension roller to be rolled back in said second reverse direction.

12. The method of claim 11, wherein a weight of said tension roller holds said fabric taut for a print duration.

13. Textile printed according to the method of claim 9.

14. A roll of textile, or a garment, or a draping, or upholstery, printed according to the method of claim 9.

* * * * *